United States Patent [19]

Akiyama et al.

[11] Patent Number: 4,983,057

[45] Date of Patent: Jan. 8, 1991

[54] RIBBON POSITION SELECTING DEVICE FOR PRINTER

[75] Inventors: Sigemi Akiyama; Hidekazu Ishii, both of Shizuoka, Japan

[73] Assignee: Tokyo Electric Co., Ltd., Tokyo, Japan

[21] Appl. No.: 864,314

[22] Filed: May 19, 1986

[30] Foreign Application Priority Data

May 27, 1985 [JP] Japan ..... 60-113389

[51] Int. Cl.[5] ..... B41J 35/14

[52] U.S. Cl. ..... 400/216.2

[58] Field of Search ..... 400/216.1, 216.2, 216.3, 400/216.4, 216.5, 240.3, 240.4

[56] References Cited

U.S. PATENT DOCUMENTS

| | | | |
|---|---|---|---|
| 2,747,718 | 5/1956 | May | 400/216.2 |
| 3,595,362 | 7/1971 | Wolowitz | 400/216.2 |
| 3,891,078 | 6/1975 | Jung | 400/216.5 X |
| 4,341,479 | 7/1982 | Sanada | 400/216.3 X |
| 4,368,993 | 1/1983 | Brass et al. | 400/216.2 |
| 4,573,813 | 3/1986 | Aoki et al. | 400/216.1 X |
| 4,693,619 | 9/1987 | Ishii et al. | 400/216.1 X |

FOREIGN PATENT DOCUMENTS

| | | | |
|---|---|---|---|
| 55614 | 7/1982 | European Pat. Off. | 400/216.1 |
| 3301933 | 7/1984 | Fed. Rep. of Germany | 400/216.2 |
| 185289 | 10/1983 | Japan | 400/216.3 |

*Primary Examiner*—Clifford D. Crowder

*Attorney, Agent, or Firm*—Oblon, Spivak, McClelland, Maier & Neustadt

[57] ABSTRACT

In a ribbon position selecting device for a printer which includes a step motor for driving a ribbon base retaining a ribbon cassette to locate a ribbon at a predetermined position, the present invention comprises a stopper for determining a reference position of the ribbon cassette, and a power transmitting mechanism for transmitting power of the step motor to the ribbon base. The power transmitting mechanism comprises a torque limiter and a one-way clutch. When the ribbon cassette is brought into abutment against the stopper, the step motor is rotated without step out owing to the torque limiter to prevent deviation in phase at the stop position. In contrast, when the ribbon cassette is driven to separate from the stopper, slipping in the power transmitting mechanism is eliminated by the one-way clutch to secure feeding of the ribbon cassette, thereby eliminating the possibility of mixing of colors.

4 Claims, 5 Drawing Sheets

RIBBON POSITION SELECTING DEVICE FOR PRINTER

FIELD OF THE INVENTION

The present invention relates to a multi-color printer employing a multi-color ribbon having a plurality of different color zones as vertically arranged, and more particularly to a ribbon position selecting device for the printer which is operated to select a desired zone of the multi-color ribbon in a printing position.

BACKGROUND OF THE INVENTION

There will be described an example of this type device in the prior art with reference to FIG. 8. Referring to FIG. 8, there is provided a carrier 2 reciprocating along an axis of a platen 1. A ribbon base 3 for detachably retaining a ribbon cassette 10 for the multi-color ribbon is pivotably mounted to the ribbon base 3 by a support shaft 4. A step motor 5 and gears 6, 7 and 8 sequentially driven by the step motor 5 are mounted to the carrier 2. A fan-shaped gear 9 meshing with the gear 8 is fixed to the ribbon base 3. In this prior art device, when rotation of the step motor 5 is transmitted from the gears 6, 7 and 8 to the gear 9, the ribbon base 3 is vertically pivoted with the ribbon cassette 10 in a direction perpendicular to the platen 1, thus arranging a desired color zone of the ribbon in opposed relation with the platen 1.

In the case that the ribbon is a four-color ribbon having the width of 19 mm, that is, a width of 4.75 mm for each color zone, a height of characters is generally 3.2–4.1 mm, and assuming that the height is 4.1 mm, upper and lower margins on both sides of each color zone are only 0.325 mm. Therefore, if vertical deviation of position of the ribbon is created, there will occur mixing of colors. To cope with this problem, a stopper 11 abutable against the ribbon base 3 is mounted to the carrier 2 to determine a reference position of the ribbon cassette 10, and a fixed pulse is applied to the step motor 5 to determine a moving range of the ribbon base 3. Thus, a ribbon selecting position with respect to the platen 1 is controlled.

However, the following problems are included in the prior art. If the printer is initialized under the condition that the ribbon base 3 is located at the reference position, the step motor 5 falls out of step since no slip is generated among the gears 6, 7 and 8 and the gear 9. Accordingly, even if the step motor 5 is stopped, and is driven again by applying a pulse by the predetermined number of steps, deviation of phase upon step out of the step motor 5 cannot be corrected. As a result, the vertical position of the ribbon is deviated to cause mixing of colors.

The aforementioned problem may be eliminated by detecting the phase of the step motor 5 upon step out, and feed-backing the detection signal to a control circuit to correct the input pulse to the step motor 5. However, these measures will cause a great increase in a production cost, and therefore they are disadvantageous in practical use.

OBJECTS OF THE INVENTION

It is a first object of the present invention to provide a ribbon position selecting device for a printer which may eliminate mixing of colors.

It is a second object of the present invention to provide a ribbon position selecting device for a printer which may reduce manufacturing cost.

It is a third object of the present invention to provide a ribbon position selecting device for a printer which may enable the step motor to be made compact.

SUMMARY OF THE INVENTION

According to the present invention, a ribbon base for retaining a ribbon cassette is mounted to a carrier in such a manner as to be vertically pivotable in a direction perpendicular to a platen. A stopper abutable against the ribbon base is mounted to the carrier, and a step motor is mounted to the carrier. A torque limiter and a one-way clutch are provided in a power transmitting mechanism for transmitting power of the step motor to the ribbon base. With this arrangement, even when the ribbon base is brought into abutment against the stopper during rotation of the step motor, and stops at a reference position, the step motor continues to be operated without step out. This is due to the fact that the torque limiter is slipped in the power transmitting mechanism. In contrast, when the ribbon cassette is driven to separate from the reference position, the power of the step motor may be securely transmitted by the one-way clutch irrespective of large frictional resistance during transmission of the power. Accordingly, phase of the step motor at stopping of the operation is kept at a specified phase, and position of the ribbon cassette with respect to the platen may be accurately and easily set by driving the step motor on the basis of this phase by the number of steps corresponding to the quantity of movement of the ribbon base. Thus, mixing of colors may be prevented.

DETAILED DESCRIPTION OF PREFERRED EMBODIMENTS

Figure 8:
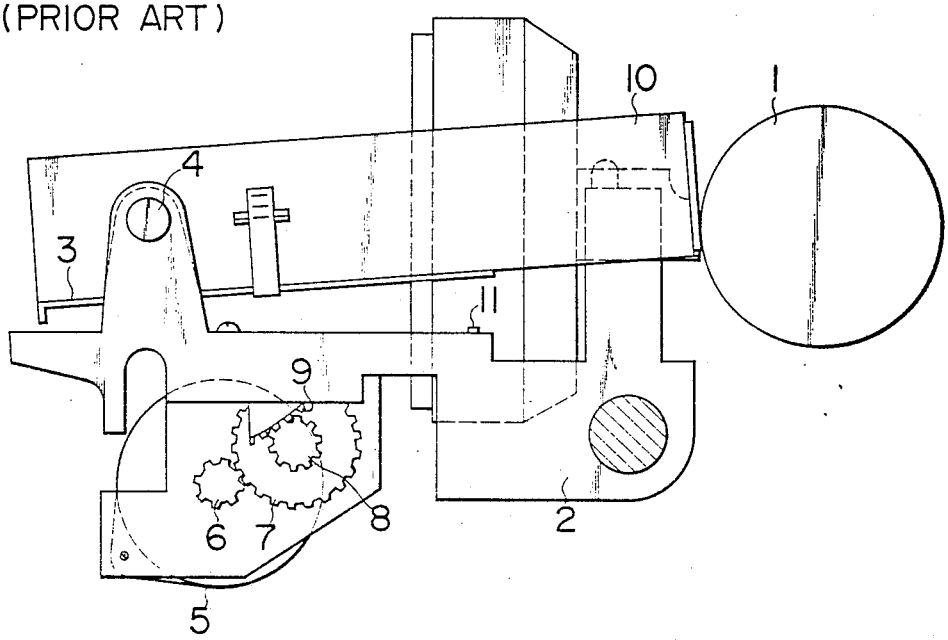
FIG. 8 (PRIOR ART)
FIG. 8 is a side view of an exemplary ribbon position selecting device in the prior art.

There will be now described a preferred embodiment of the present invention with reference to FIGS. 1 to 6, in which like parts shown in FIG. 8 are designated by the same reference numerals. A carrier 2 for retaining a printing head 14 as a printing unit is slidably retained to guide shafts 12 and 13 parallel to a platen 1. A ribbon base 3 is retained to the carrier 2 in such a manner as to be vertically pivotable about support shafts 4. An adjusting screw 15 as a stopper is threadedly engaged with the carrier 2. The ribbon base 3 is provided with clamps 16 for detachably retaining a ribbon cassette 10, and is also provided with a fan-shaped gear 9 rotatable about the support shafts 4. The carrier 2 is provided with a step motor 5 and gears 6, 7 and 8 for sequentially transmitting power from the step motor 5 to the gear 9. These gears 6, 7, 8 and 9 forms a power transmitting mechanism 17.

The ribbon cassette 10 is constituted of a ribbon 19 having four-color printing zones 20, 21, 22 and 23 and a cassette case 25 for accommodating the ribbon 19. The cassette case 25 is provided on its lower surface with a ribbon feed roller 24 to be driven by a ribbon driving shaft (not shown) formed on the carrier 2, and is formed on its both sides with arms 26 extending to both sides of the tip of the printing head 14. There are further provided ribbon guides (not shown) inside of the end portions of the arms 26 for slidably retaining the ribbon 19 so as to prevent the ribbon 19 from being transversely slackened.

A one-way clutch 27 is provided at an engagement portion between the gears 7 and 8. That is to say, a ring-like clutch disc 27*a* is fixed to the gear 8 in axial alignment therewith, and the gear 7 is rotatably engaged with the outer circumferential surface of the clutch disc 27*a*. The clutch disc 27*a* is formed at its outer circumferential surface with three recesses 27*b* communicating with the inner circumferential surface of the gear 7. Each of the recesses 27*b* includes a roller 27*c* and a biasing spring 27*d*. Each roller 27*c* is biased against the clutch disc 27*a* and the gear 7 by means of the associated biasing spring 27*d*.

Further, a torque limiter 30 is formed at a connecting portion between the gears 7 and 8. That is to say, the gear 8 is formed with a flange 28 at one end thereof, and a spring 29 is interposed between the flange 28 and the gear 7. The torque upon slipping of the spring 29 on one surface of the gear 7 is set to be less than the pull-out torque of the step motor 5.

In operation, the adjusting screw 15 is abutted against the lower surface of the ribbon base 3 so as to arrange the uppermost printing zone 20 of the ribbon 19 in opposed relation with a printing position of the platen 1. If the position of the adjusting screw 15 is regarded as a reference position, the ribbon base 3 is required to be vertically moved by three steps, so as to arrange each of the printing zones 20, 21, 22 and 23 in opposed relation with the printing position of the platen 1. Assuming that the number of steps of the step motor 5 required for the movement of the ribbon base 3 by one step is 10, the number of steps required for the maximum motive range of the ribbon base 3 becomes 30. In this case, the step motor 5 is driven with the number of steps specified to 30 or more in the direction where the ribbon base 3 is brought into abutment against the adjusting screw 15 irrespective of the position of the ribbon base 3. As a result, even after the ribbon base 3 comes into abutment against the adjusting screw 15, the step motor 5 continues to be rotated according to a pulse input to the step motor 5 since the step motor 5 is rotated by the fixed number of steps without step out by the slipping action of the torque limiter 18. At this time, the step motor 5 keeps a preliminarily specified phase. Accordingly, pulses corresponding to the numbers of steps 10, 20 and 30 are input into the step motor 5 to drive the same, so that a desired one of the printing zones 20, 21, 22 and 23 may be arranged in opposed relation with the printing position of the platen 1.

Figure 6:
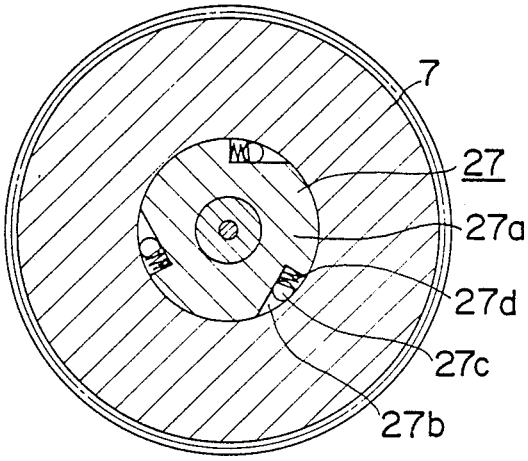
FIG. 6 is a side view in vertical section of a one-way clutch.

In the case that the step motor 5 is reversely rotated, the ribbon base 3 is raised to arranged a desired one of the printing zones 20, 21, 22 and 23 of the ribbon 19 in opposed relation with the printing position. Upon rising of the ribbon base 3 with a large load and a large frictional resistance in the power transmitting mechanism 17, the torque limiter 30 tends to slip, but power transmission from the gear 7 to the gear 8 is securely carried out by means of the one-way clutch 27. As shown in FIG. 6, when the clutch disc 27*a* of the one-way clutch 27 is clockwise rotated, the biasing springs 27*d* are compressed by the rollers 27*c*, and the rollers 27*c* are located with a spatial looseness defined in the recesses 27*b*. As a result, there is created slip between the clutch disc 27*a* and the gear 7. On the other hand, when the clutch disc 27*a* is rotated clunterclockwise, the rollers 27*c* are biased against the clutch disc 27*a* and the gear 7 by means of the biasing springs 27*d* to thereby rotate the gear 7 integrally with the clutch disc 27*a*. In this manner, the one-way clutch 27 acts to slip the gears 7 and 8 when the ribbon base 3 comes into abutment against the adjusting screw 15, and also acts to integrally operate the gears 7 and 8 with no slip when the ribbon base 3 is separated from the adjusting screw 15.

Figure 1:
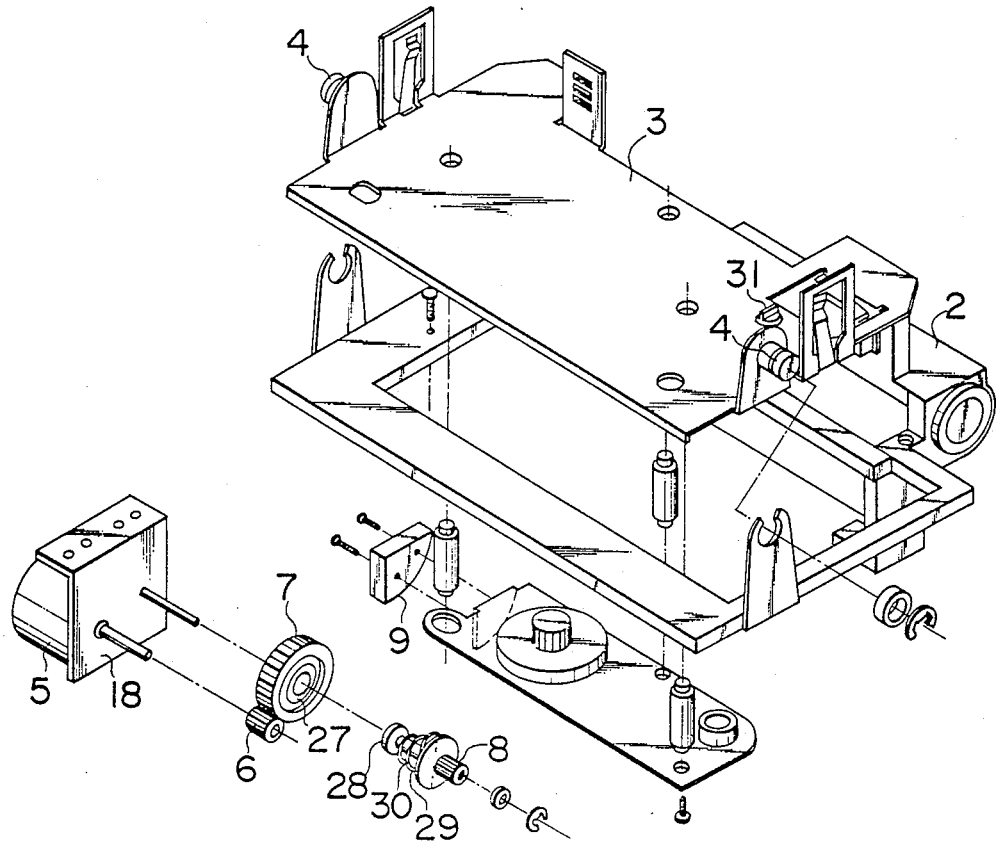
FIG. 1 is an exploded perspective view of a first preferred embodiment according to the present invention.
Figure 2:
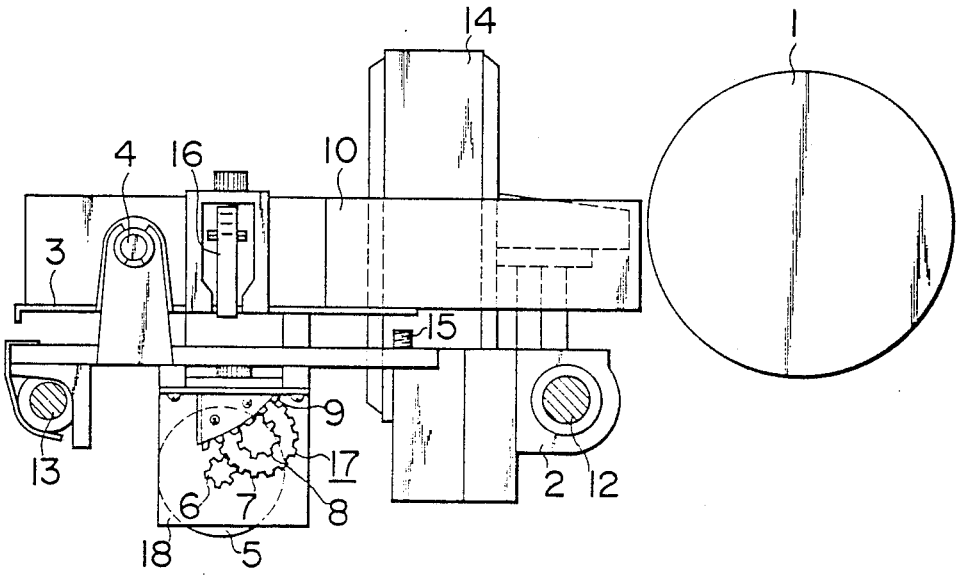
FIG. 2 is a side view of a ribbon base as lifted from a reference position.
Figure 3:
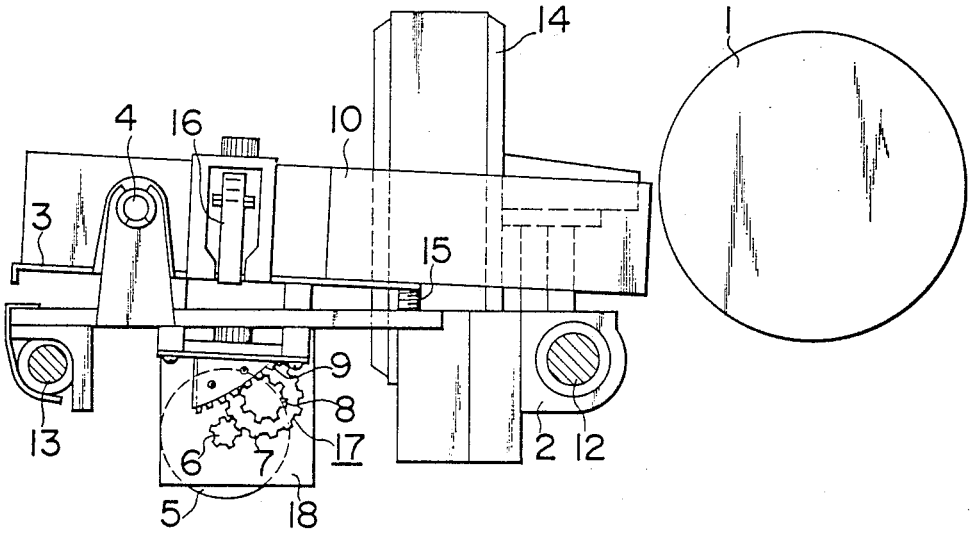
FIG. 3 is a side view of a ribbon base as located at the reference position.
Figure 4:
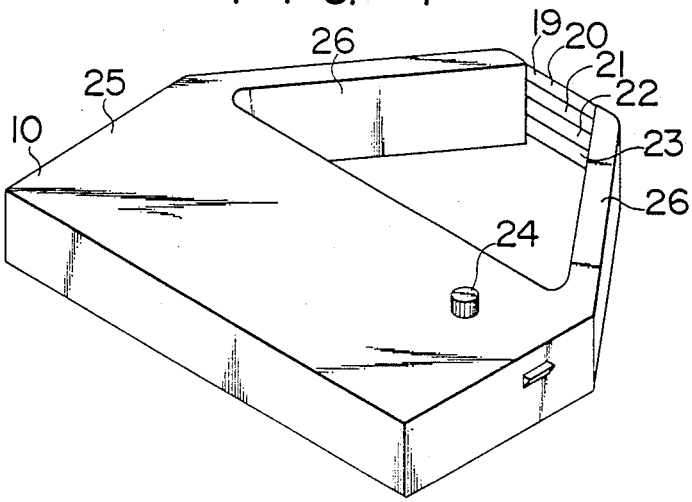
FIG. 4 is a perspective view of a ribbon cassette.
Figure 5:
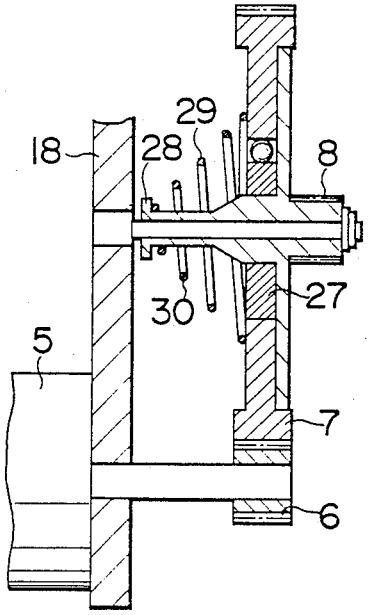
FIG. 5 is a rear view in vertical section of a torque limiter and a one-way clutch.

FIG. 3 shows a condition that the ribbon base 3 is in the reference position where the uppermost printing zone 20 is opposed to the printing position of the platen 1, while FIG. 2 shows another condition that the second printing zone 21 is opposed to the printing position of the platen 1 by lifting the ribbon base 3 from the reference position by the quantity of 10 steps.

As is mentioned above, the reference position of the ribbon base 3 may be very easily determined without step out of the step motor 5. After determination of the reference position, a desired one of the printing zones 20, 21, 22 and 23 may be accurately located at the printing position of the platen 1 by the control of the step motor 5. Accordingly, it is possible to prevent mixing of colors due to vertical shift of the ribbon in printing. At the same time, since any complicated mechanisms and electric control means are not required for phase matching of the step motor 5 at the reference position, a manufacturing cost may be reduced. Furthermore, since power transmission from the gear 7 to the gear 8 is securely carried out by the one-way clutch 27 upon lifting of the ribbon base 3, the spring 29 is not necessarily strong, and relatively the step motor 5 may be made compact. Additionally, the ribbon base 3 may be stopped at an arbitrary position by maintaining the step motor 5 at an excited state, thus omitting a detent mechanism for positioning the ribbon base 3.

Figure 7:
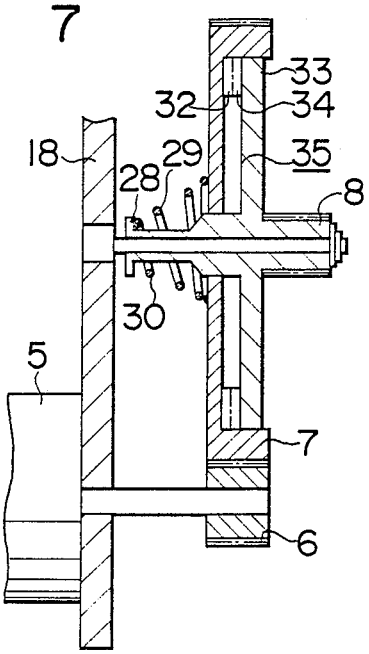
FIG. 7 is a rear view in vertical section of a torque limiter and a one-way clutch in a second preferred embodiment of the present invention.

There will be now described a second preferred embodiment of the present invention with reference to FIG. 7, in which identical parts in the first embodiment are designated by the same reference numerals, and explanation therefor will be omitted. As shown in FIG. 7, a one-way clutch 35 is formed by a ratchet pawl 32 formed on one surface of a gear 7 and a ratchet pawl 34 formed on a flange 33 of a gear 8. With this arrangement, when the gear 7 is rotated in one direction, the ratchet pawls 32 and 34 are meshed with each other. In contrast, when the gear 7 is rotated in the other direction, the ratchet pawls 32 and 34 are slipped.

What is claimed is:

1. A printer comprising:

(a) a platen having a printing position;

(b) a carrier;

(c) a printing unit mounted on said carrier;

(d) a ribbon base mounted on said carrier in such a manner as to be vertically movable in a direction perpendicular to said platen;

(e) a ribbon cassette for a multi-color ribbon having a plurality of differently colored, vertically spaced zones detachably mounted on said ribbon base;

(f) a stopper mounted on said carrier and adapted to come into abutment against said ribbon base to locate said ribbon cassette at a reference position;

(g) a step motor mounted on said carrier;

(h) a power transmitting mechanism for receiving rotation of said step motor and vertically moving said ribbon base;

(i) said step motor being sized so that it requires a plurality of steps to move said ribbon base so that a different one of said zones is in opposed relation to the printing position of said platen;

(j) a torque limiter provided in said power transmitting mechanism and adapted to be slipped with a torque smaller than the pull-out torque of said step motor; and (k) a one-way clutch provided in said power transmitting mechanism for transmitting rotation of said step motor in the direction such that said ribbon base is driven to separate from said reference position, whereby:

(l) when said ribbon base is brought into abutment against said stopper during rotation of said step motor, causing said ribbon cassette to be located at its reference position, said step motor continues to operate without step out due to the fact that said torque limiter and said one-way clutch are slipped in said power transmitting mechanism; and (m) when said ribbon cassette is driven to separate from its reference position, the power of said step motor is securely transmitted to said ribbon base by said one-way clutch irrespective of large frictional resistance during transmission of the power and the phase of said step motor at stopping of the operation is kept at a specified phase, thereby permitting the position of said ribbon cassette with respect to the printing position of said platen to be accurately set by driving said step motor on the basis of this phase, permitting accurate use of the number of steps corresponding to the desired quantity of movement of said ribbon base, and preventing mixing of the colors.

2. The printer according to claim 1 wherein said power transmitting mechanism comprises:

(a) a first gear mounted on said ribbon base in such a manner as to be rotatable about a pivotal center of said ribbon base and (b) a plurality of second gears connecting said first gear to said step motor.

3. The printer according to claim 2 wherein said torque limiter comprises a coil spring connecting two of said second gears.

4. The printer according to claim 2 wherein said one-way clutch comprises a ratchet pawl connecting two of said second gears.

* * * * *